US006532755B2

(12) United States Patent
Ichikawa et al.

(10) Patent No.: US 6,532,755 B2
(45) Date of Patent: Mar. 18, 2003

(54) BRINE COOLING APPARATUS

(75) Inventors: Yoshifumi Ichikawa, Shizuoka (JP); Tsuneji Morohoshi, Shizuoka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/152,575

(22) Filed: May 23, 2002

(65) Prior Publication Data

US 2002/0134097 A1 Sep. 26, 2002

Related U.S. Application Data

(63) Continuation of application No. 09/843,717, filed on Apr. 30, 2001, which is a continuation of application No. 09/391,079, filed on Sep. 16, 1999, now Pat. No. 6,253,566.

(51) Int. Cl.[7] ..... F25D 11/00; F25B 1/00

(52) U.S. Cl. ..... 62/228.3; 62/430; 62/434; 62/229; 62/228.1

(58) Field of Search ..... 62/434, 430, 229, 62/228.3, 228.1

(56) References Cited

U.S. PATENT DOCUMENTS

| | | | | |
|---|---|---|---|---|
| 4,351,160 | A | 9/1982 | Kountz et al. | |
| 4,581,829 | A | 4/1986 | Becker et al. | |
| 4,707,996 | A | 11/1987 | Vobach | |
| 4,794,763 | A | 1/1989 | Kikuchi | |
| 5,671,607 | A | 9/1997 | Clemens et al. | |
| 5,688,433 | A | 11/1997 | Kasahara et al. | |
| 5,752,391 | A | 5/1998 | Ozaki | |
| 5,765,392 | A | 6/1998 | Baur | |
| 5,974,821 | A | 11/1999 | Scherer et al. | |
| 6,112,534 | A | 9/2000 | Taras et al. | |
| 6,418,749 | B2 * | 7/2002 | Ichikawa et al. | 62/434 |

FOREIGN PATENT DOCUMENTS

| | | |
|---|---|---|
| JP | 9210479 | 8/1997 |
| JP | 10170124 | 6/1998 |

* cited by examiner

*Primary Examiner*—William C. Doerrler
*Assistant Examiner*—Mark Schulman
(74) *Attorney, Agent, or Firm*—Antonelli, Terry, Stout, Kraus, LLP

(57) ABSTRACT

A brine cooling apparatus is provided which addresses an environmental problem by not contributing to global warming and can prevent brine from freezing within a heat exchanger. The apparatus is structured such that a screw compressor, a condenser, a main expansion valve and an evaporator are connected by a pipe so as to cool brine flowing through the evaporator. The refrigerant is an ammonia refrigerant, the evaporator is a plate type heat exchanger constructed by laying a plural sheets of plates, and capacity control means is provided in such a manner as to control a capacity of the screw compressor in accordance with the flow amount of the brine.

4 Claims, 4 Drawing Sheets

OPERATION TABLE OF ELECTROMAGNETIC VALE

| ELECTROMAGNETIC VALVE / CAPACITY OF COMPRESSOR | 20A | 20B | 20C |
|---|---|---|---|
| 100% | OPEN | CLOSE | OPEN |
| 50% | CLOSE | OPEN | CLOSE |

NOTE : "OPEN" CORRESPONDING TO ENERGIZING OF ELECTROMAGNETIC VALVE T

BRINE COOLING APPARATUS

This application is a continuation application of U.S. Ser. No. 09/843,717, filed Apr. 30, 2001, which is a continuation application of U.S. Ser. No. 09/391,079, filed Sept. 16, 1999 (now U.S. Pat. No. 6,253,566, granted Jul. 3, 2001).

BACKGROUND OF THE INVENTION

The present invention relates to a cooling apparatus for circulating a cooled brine used for a freezing show case, a refrigerating show case, a freezer, a refrigerator and the like.

Conventionally, a freon refrigerant has been used as a refrigerant employed in a compression type refrigerating machine, however, by reconsidering an ozone layer breakage and an earth warming-up, it has been considered in a cooling apparatus to employ ammonia as a refrigerant. A flooded type cooling apparatus or a liquid circulating type cooling apparatus are described, for example, in Japanese Patent Unexamined Publication No. 10-170124 as a cooling apparatus employed in an ammonia freezer.

Further, in order to reduce an amount of the refrigerant sealed within a refrigerating cycle, it has been known to be proper to use a plate type heat exchanger represented by a herringbone plate, a corrugate plate and the like in an evaporator.

Since a large amount of refrigerant is required in the flooded type and liquid circulating type cooling apparatuses in accordance with the prior art, they do not address the problems of the ozone layer breakage and global warming, and it is necessary to sufficiently consider an efficiency, a risk and the like in the case of employing ammonia.

Further, in the case of using the plate type heat exchanger, it is necessary to consider a risk that an internal freezing is generated when a flow rate of the brine is reduced and a heat transmitting pipe forming the heat exchanger is clogged so as to be deformed or broken.

SUMMARY OF THE INVENTION

An object of the present invention is to provide a brine cooling apparatus which can solve the problems mentioned above, prevent a brine from freezing within a heat exchanger, improve reliability and secure a stable operation.

Further, another object of the present invention is to provide a brine cooling apparatus which addresses an environmental problem by reducing an amount of used refrigerant, reducing a fear of breaking the ozone layer and preventing global warming.

Still further, another object of the present invention is to provide a brine cooling apparatus which can secure an improvement in performance with a reduced amount of a refrigerant, provide an improved efficiency even when employing a natural type refrigerant, and increase safety with respect to combustibility and a poison of the natural type refrigerant.

Here, the present invention is constituted such as to solve at least one of the problems mentioned above.

In order to achieve the objects mentioned above, in accordance with the present invention, there is provided a brine cooling apparatus including a screw compressor, a condenser, a main expansion valve, an evaporator, a pipe for connecting the screw compressor, the condenser, the main expansion valve and the evaporator, a refrigerant evaporated by the evaporator, and brine flowing through the evaporator. The brine is cooled by evaporating the refrigerant by the evaporator. The refrigerant is an ammonia refrigerant, the evaporator is a plate type heat exchanger constructed by stacking a plurality of plates, and capacity control means is provided in such a manner as to control a capacity of the screw compressor in accordance with the flow rate of the brine.

Since ammonia is employed as the refrigerant, there is no risk of breaking the ozone layer and warming the earth, and an amount of the used refrigerant can be reduced to serve as an evaporator. The plate type heat exchanger is structured by stacking a plurality of plates. Then, since the capacity of the screw compressor which can obtain a high output is controlled in accordance with the flow rate of the brine, freezing within the heat exchanger caused by reducing the amount of the sealed refrigerant can be prevented and reliability can be improved.

Further, in accordance with the present invention, there is provided a brine cooling apparatus including a screw compressor, a condenser, a main expansion valve, an evaporator, a pipe for connecting the screw compressor, the condenser the main expansion valve and the evaporator, a refrigerant evaporated by the evaporator, and brine flowing through the evaporator, the brine being cooled by evaporating the refrigerant by the evaporator. The refrigerant is an ammonia refrigerant, the evaporator is a plate type heat exchanger constructed by stacking a plurality of plates, flow rate detecting means for detecting a flow rate of the brine is provided, and capacity control means is provided in such a manner as to reduce an operating capacity of the screw compressor in the case that the reduction of the flow rate of the brine is detected by the flow amount detecting means.

A cooling load is reduced together with a reduction of the flow rate of the brine; however, since the operating capacity of the screw compressor is reduced in the case that the reduction of the flow amount of the brine is detected, a temperature of the brine is not excessively lowered to a freezing temperature. Accordingly, it is possible to prevent freezing within the heat exchanger and improve reliability.

Still further, in accordance with the present invention, there is provided a brine cooling apparatus including a screw compressor, a condenser, a main expansion valve, an evaporator, a pipe for connecting the screw compressor, the condenser, the main expansion valve and the evaporator, a refrigerant evaporated by the evaporator, and brine flowing through the evaporator, the brine being cooled by evaporating the refrigerant by the evaporator. The refrigerant is an ammonia refrigerant, the evaporator is a plate type heat exchanger constructed by stacking a plurality of plates, and suction pressure detecting means for detecting a suction pressure of the compressor and capacity control means are provided in such a manner as to reduce an operating capacity of the screw compressor in the case that it is judged by the suction pressure detecting means that the suction pressure of the compressor is lowered.

When the flow rate of the brine is reduced, the cooling load is reduced and the suction pressure of the compressor is lowered. Then, in the case that it is judged by the suction pressure detecting means that the suction pressure of the compressor is lowered, the operating capacity of the screw compressor is reduced, so that it is possible to prevent the brine within the heat exchanger from freezing during a normal continuous operation.

Furthermore, in accordance with the present invention, there is provided a brine cooling apparatus including a screw compressor, a condenser, a main expansion valve, an evaporator, a pipe for connecting the screw compressor, the condenser, the main expansion valve and the evaporator, an ammonia refrigerant evaporated by the evaporator, and brine flowing through the evaporator, the brine being cooled by evaporating the refrigerant by the evaporator. The evaporator is a plate type heat exchanger constructed by stacking a plurality of plates, and capacity control means for controlling a capacity of the screw compressor, suction pressure detecting means for detecting a suction pressure of the compressor, and capacity control means for reducing an operating capacity of the screw compressor in the case that the suction pressure of the compressor is continued lower than or equal to a predetermined value for a fixed time are provided.

Accordingly, since the operating capacity of the screw compressor is reduced in the case that the suction pressure of the compressor is continued lower than or equal to a predetermined value for a fixed time, it is possible to securely prevent the brine within the heat exchanger from freezing during a normal continuous operation, so that the plate type heat exchanger can be used for the exchanger in order to reduce the amount of the ammonia sealed within the refrigerating cycle, and the structure can be made preferable for preventing the ozone layer breakage and the global warming.

Further, in accordance with the present invention, in the brine cooling apparatus mentioned above, it is desirable to set the predetermined value of the suction pressure to a saturated pressure corresponding to a temperature 5 to 10° C. higher than the brine freezing temperature.

Still further, in accordance with the present invention, in the brine cooling apparatus mentioned above, it is preferable to reduce the operating capacity of the screw compressor from a 100% operating capacity to a 50% operating capacity in view of an operating efficiency and the like in the case of again returning to a cooling operation from the operation for preventing the freezing.

Furthermore, according to the present invention, in the brine cooling apparatus mentioned above, it is advantageous to employ a pressure switch as the suction pressure detecting means in view of cost reduction and reliability.

DESCRIPTION OF THE PREFERRED EMBODIMENTS

Hereinafter, an embodiment in accordance with the present invention will be described with reference to FIGS. 1 to 6.

Figure 1:
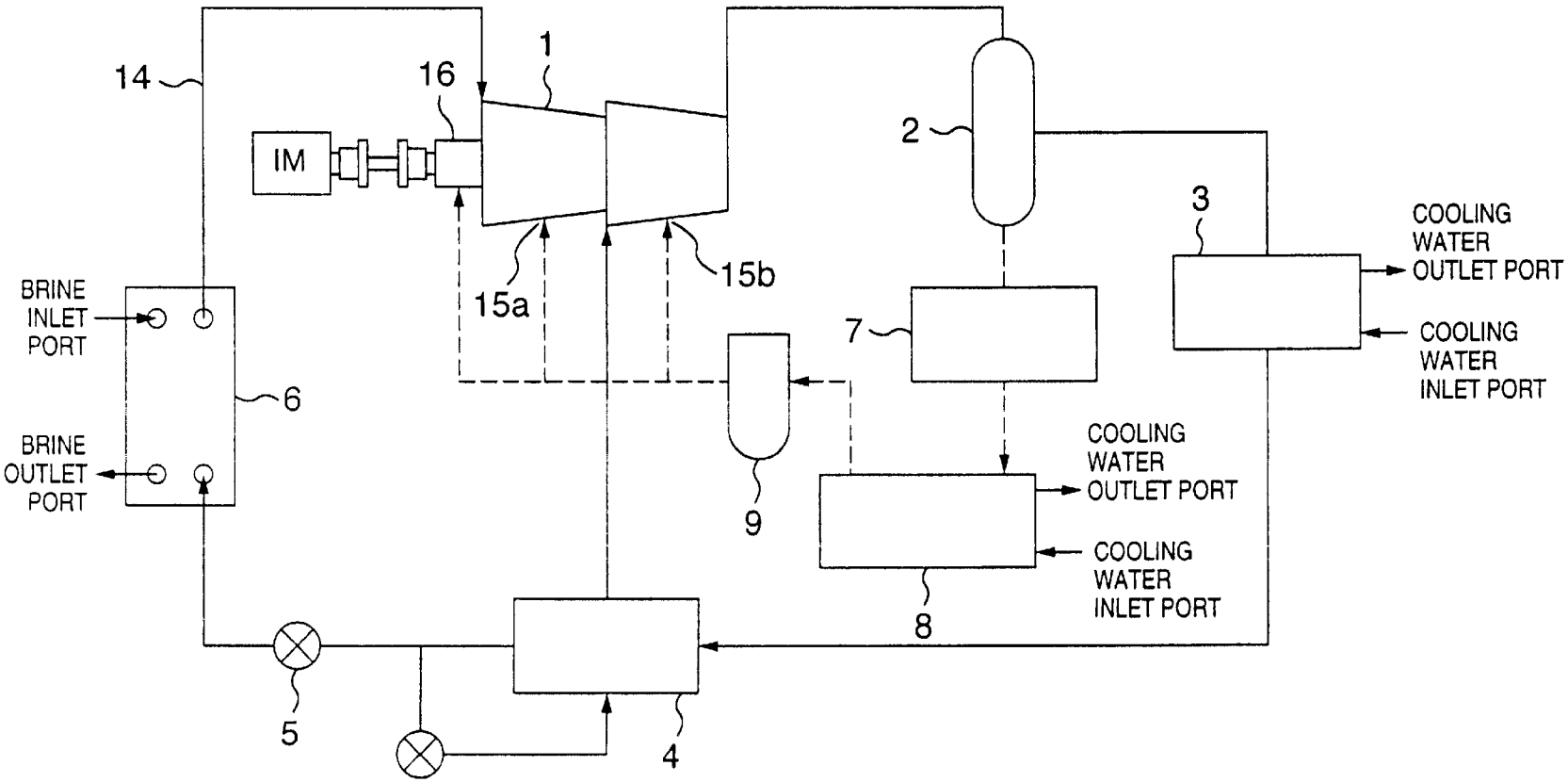
FIG. 1 is a schematic view of a cycle system of a brine cooling apparatus in accordance with an embodiment of the present invention.

FIG. 1 is a schematic view of a cycle system in an ammonia refrigerating cycle, in which a solid line shows a flowing direction of a refrigerant and a broken line shows a flowing direction of a refrigerating machine oil. A compressor is structured such that open-type screw compressors 1 are arranged in two stages, an ammonia (gas) is compressed by low stage and high stage rotors in the screw compressor 1 so as to become a gas having a high temperature and a high pressure and be discharged together with the refrigerating machine oil, thereby being separated into the refrigerant gas and the refrigerating machine oil within an oil separator 2.

The refrigerant gas is condensed to a condensed liquid by a cooling water in a condenser 3, is further lowered in temperature by a supercooler 4, becomes a wet gas having a low temperature by a main expansion valve 5, and is sucked into the screw compressor 1 after an operation of cooling brine corresponding to a cooled subject within a plate type heat exchanger 6 corresponding to an evaporator.

Figure 2:
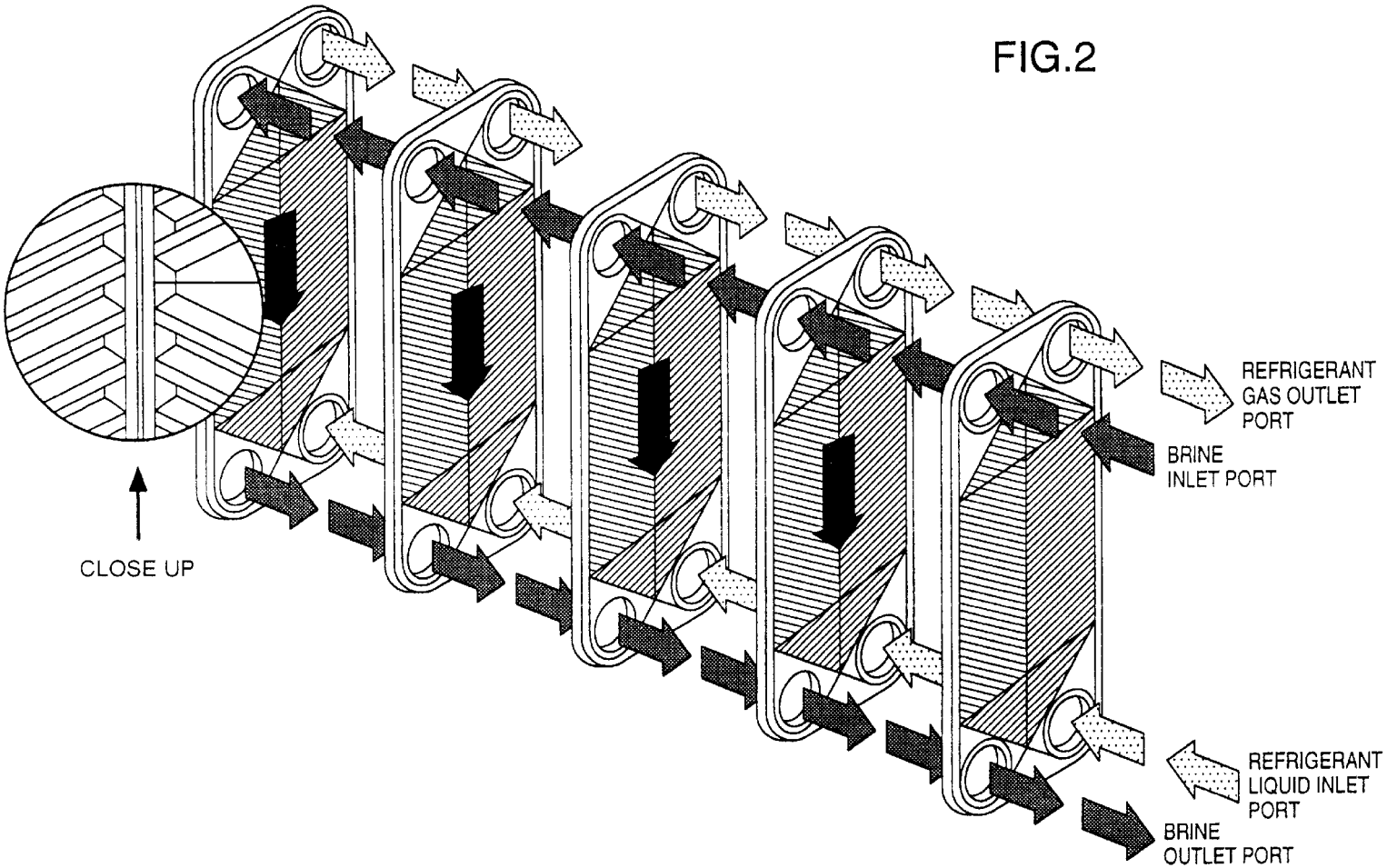
FIG. 2 is a perspective view of a structure of a plate type heat exchanger 6 in accordance with an embodiment of the present invention.

FIG. 2 is a perspective view which shows a structure of brine outlet and inlet ports in the plate type heat exchanger, and the brine is flowed into from an upper inlet port in the plate type heat exchanger. The ammonia refrigerant is evaporated, whereby the brine is cooled while flowing toward the lower portion from the upper portion and is discharged from a lower outlet port in a state that its temperature is reduced.

When a flow rate of the brine is reduced, a flow of the brine becomes nonuniform within the plate type heat exchanger 6, so that in comparison with a flow passage having a normal flow within the plate, a passing speed of the brine is significantly lowered or the brine does not flow so as to be stayed. Accordingly, the brine staying within the plate type heat exchanger 6 is cooled in accordance that the ammonia refrigerant is evaporated within the plate type heat exchanger 6, and gradually starts freezing.

Since an evaporation of the ammonia refrigerant is continued, the freezing of the brine is further increased and the flow rate of the brine is reduced, so that there is a case that an air is mixed into the plate type heat exchanger 6. Accordingly, a concentration of the brine is lowered, a freezing temperature is increased and brine freezing is easily caused.

When the brine is frozen within the plate type heat exchanger 6, there is a case that each of the stacked plates is deformed or broken, so that the ammonia refrigerant is leaked within the brine cycle or leaked out to an external portion, whereby there is a risk of applying an influence such as corrosion and the like to the other equipment.

On the other hand, the refrigerating machine oil separated by the oil separator 2 is discharged to an oil tank 7 and enters into an oil cooler 8 from the oil tank 7. The refrigerating machine oil cooled by the cooling water in the oil cooler 8 is supplied to bearing portions 15*a* and 15*b* and a shaft sealing apparatus portion 16 corresponding to an intermediate pressure portion of the screw compressor 1 after a foreign substance in the oil is removed in an oil strainer 9.

Figure 3:
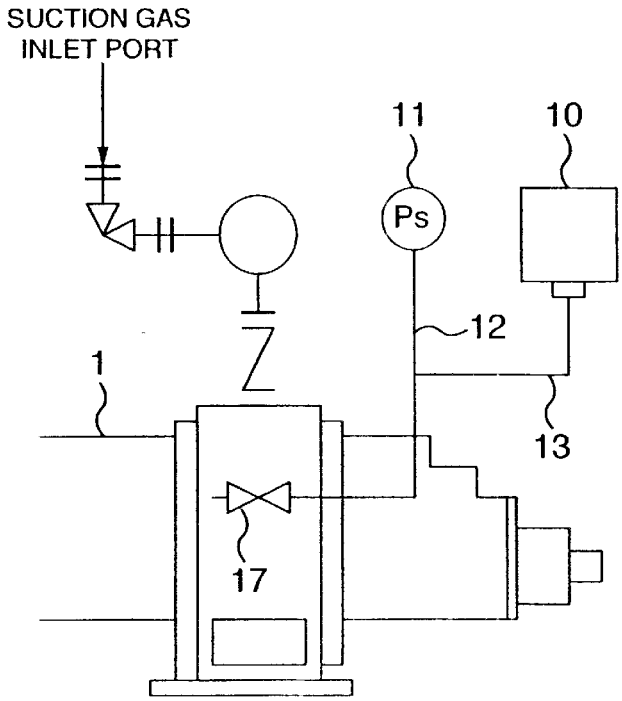
FIG. 3 is a schematic view of a method of connecting a pipe of a pressure switch 10 for preventing a freezing in accordance with an embodiment of the present invention.

FIG. 3 is a schematic view which shows a method of connecting a pipe of a pressure switch 10 for preventing freezing, in which a compound pressure gauge 11 displaying a suction pressure of the screw compressor 1 is connected to a suction pressure portion of the screw compressor 1 via a service valve 17 by a pipe 12, the pipe 12 is branched, and one of the branched pipes is connected to the freezing preventing pressure switch 10 by a pipe 13 having the same size so as to detect the suction pressure of the screw compressor 1.

Figure 4:
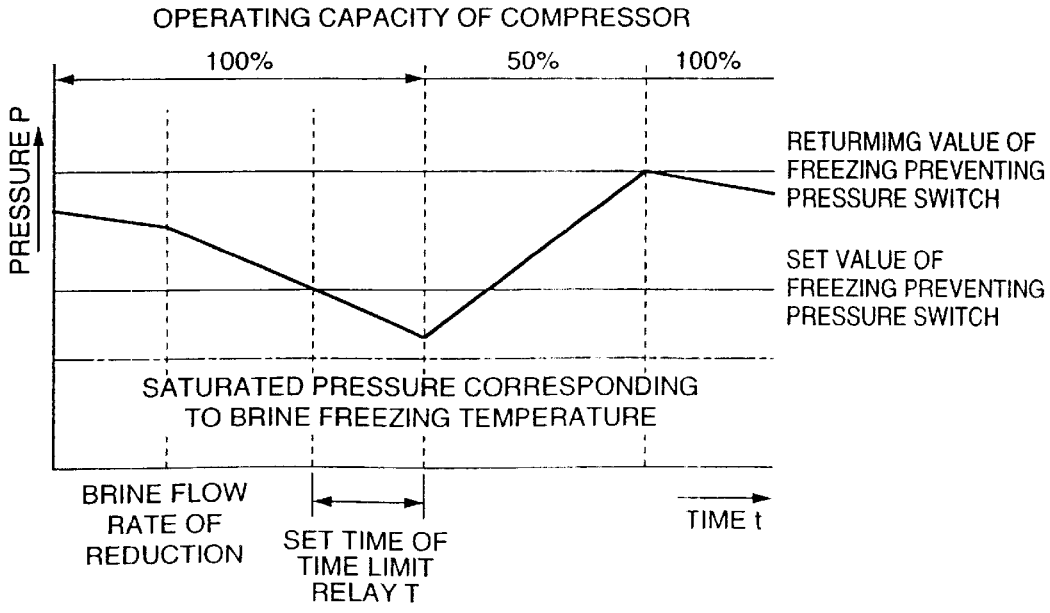
FIG. 4 is a graph of a change of a suction pressure of a screw compressor in accordance with an embodiment of the present invention.
Figures 5, 6:
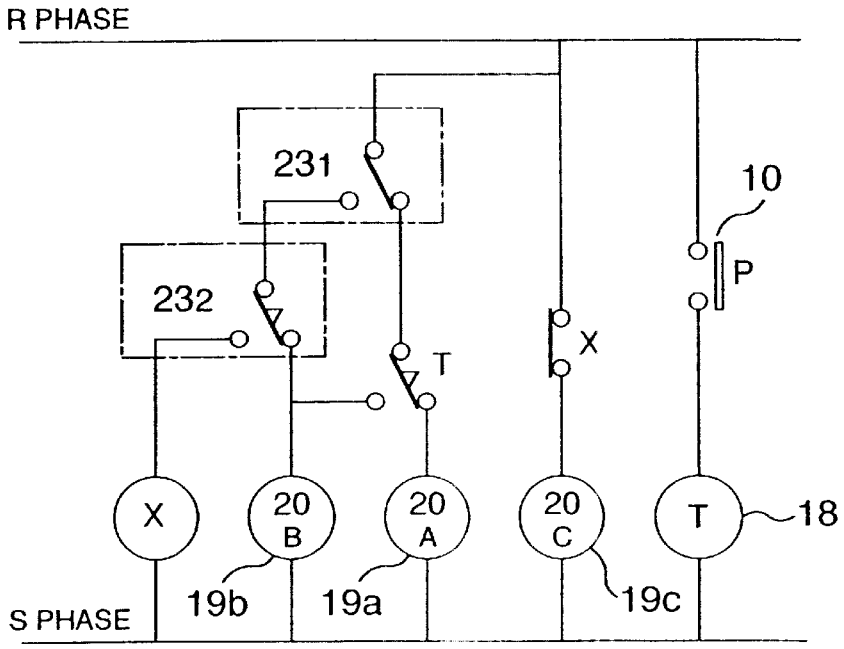
FIG. 5 is a schematic view of a sequence circuit in accordance with an embodiment of the present invention.
FIG. 6 is an operation table of a capacity control electromagnetic valve 19 in accordance with an embodiment of the present invention.

FIG. 4 is a graph which shows a change of the suction pressure of the screw compressor 1, FIG. 5 shows a sequence circuit for detecting the suction pressure so as to perform a capacity control, and FIG. 6 shows an operation of the capacity controlling electromagnetic valve.

In the compressor 1, at a time of 100% load, capacity controlling electromagnetic valves (20A and 20C) 19*a* and 19*c* are in an open state, and when the flow rate of the brine within the plate type heat exchanger 6 is reduced during the operation under 100% load, a cooling load is also reduced, so that the main expansion valve 5 performs a control in a closing direction and the suction pressure is lowered.

Then, in the case that the suction pressure of the screw compressor 1 is lowered to a set value of the freezing preventing pressure switch 10 and this value is continued for a set time of a time limit relay 18, the respective capacity controlling electromagnetic valves (20B and 20C) 19*b* and 19*c* of the two-stage screw compressor 1 are energized so as to be in an open state, thereby shifting an operation capacity to a 50% load capacity control operation.

Due to the capacity control operation, a cooling capacity of the compressor 1 is reduced, thereby preventing the brine storing within the plate type heat exchanger 6 from lowering to a freezing temperature.

Thereafter, the 50% load capacity control operation is performed until the suction pressure is increased and returned to a return value of the freezing preventing pressure switch 10, and thereafter, the operation capacity of the screw compressor 1 is returned to the 100% load so as to again perform the cooling operation.

A change of the suction pressure caused by a temperature reduction of the brine is detected at the suction pressure portion of the screw compressor 1, a saturated temperature corresponding to the suction pressure is set such as to be only a degree of the saturated temperature corresponding to a pressure loss within the plate type heat exchanger 6 and within the suction pipe 14 lower than an evaporating temperature of the ammonia refrigerant within the plate type heat exchanger 6.

That is, in the case that the suction pressure of the compressor is continued equal to or less than the predetermined value for a fixed time, the operation capacity of the screw compressor is reduced, thereby securely preventing the brine freezing within the heat exchanger during the normal continuous operation. Then, in order to reduce the amount of the ammonia sealed within the refrigerating cycle, the plate type heat exchanger is employed for the heat exchanger, thereby reducing a risk that the ozone layer is broken and the earth is warmed. Further, it is desirable to set the set value of the suction pressure to the saturated pressure corresponding to a temperature 5 to 10° C. higher than the brine freezing temperature, whereby a safer countermeasure can be obtained for preventing the brine freezing. Further, it is sufficient that the brine in this case is a fluid corresponding to the subject to be cooled, so that water can be employed as the brine.

In the brine cooling apparatus, in the case of constructing the refrigerating cycle by using ammonia as the refrigerant, it is possible to set the amount of ammonia sealed within the refrigerating cycle to a minimum refrigerant amount by employing a plate type heat exchanger 6 for the brine cooler.

Further, if the internal freezing of the plate type heat exchanger 6 caused by the reduction of the flow rate of the brine is previously prevented, it is possible to avoid a risk that the ammonia refrigerant is leaked by the breakage of the plate.

Still further, when the 50% load capacity control operation of the screw compressor 1 is performed by the operation of the freezing preventing pressure switch 10 and the suction pressure is increased to the return value of the freezing preventing pressure switch 10, the operation capacity of the screw compressor 1 is set to the 100% load so as to again return the operation to the cooling operation, whereby it is possible to avoid the brine freezing within the plate type heat exchanger 6 during the normal continuous operation without abnormally stopping the unit due to the internal freezing of the brine.

In accordance with the present invention, ammonia is employed as the refrigerant having no risk of breaking the ozone layer and warming the earth, the amount of the used refrigerant is reduced by employing the plate type heat exchanger structured such that a plurality of plates are layered for the evaporator, and the capacity of the screw compressor is controlled in accordance with the flow rate of the brine, so that it is possible to prevent the refrigerant from freezing within the heat exchanger caused by the reduction of the sealed amount of the refrigerant and it is possible to provide brine cooling apparatus having an improved reliability.

Further, in accordance with the present invention, since the operation capacity of the screw compressor is reduced in the case that the reduction of the brine flow amount is detected, the temperature of the brine is not excessively lowered to the freezing temperature, and it is possible to provide brine cooling apparatus having an improved reliability.

Still further, in accordance with the present invention, since the operation capacity of the screw compressor is reduced in the case that it is judged by the suction pressure detecting means that the suction pressure of the compressor is lowered, the reduction of the suction pressure of the compressor invites the reduction of the cooling load and the reduction of the brine flow rate, so that it is possible to prevent the brine within the heat exchanger from freezing during the normal continuous operation.

Furthermore, in accordance with the present invention, since the operation capacity of the screw compressor is reduced in the case that the suction pressure of the compressor is continuously equal to or less than the predetermined value for the predetermined time, and the plate type heat exchanger is employed for the heat exchanger, it is possible to securely prevent the brine from freezing and reduce the amount of ammonia sealed within the refrigerating cycle, thereby providing a brine cooling apparatus preferable for preventing the ozone layer breakage and global warming.

What is claimed is:

1. A brine cooling apparatus comprising a compressor, a condenser, an expansion valve, an evaporator, a pipe for connecting the compressor, the condenser, the expansion valve and the evaporator, a refrigerant evaporated by said evaporator, and a brine flowing through said evaporator, wherein said refrigerant is an ammonia refrigerant; said evaporator is a plate type heat exchanger; and a capacity controller are provided in such a manner as to reduce an operating capacity of said compressor in the case that the suction pressure of said compressor is lowered.

2. A brine cooling apparatus as claimed in claim 1, wherein the operating capacity of said compressor is reduced in the case that the suction pressure of said compressor is lower than or equal to a predetermined value.

3. A brine cooling apparatus as claimed in claim 2, wherein the predetermined value of said suction pressure is set to a pressure corresponding to a temperature 5 to 10° C. higher than the brine freezing temperature.

4. A brine cooling apparatus including a compressor, a condenser, a expansion valve, an evaporator, a pipe for connecting the compressor, the condenser, the expansion valve and the evaporator, a refrigerant evaporated by said evaporator, and a brine flowing through said evaporator, wherein said refrigerant is an ammonia refrigerant; said evaporator is a plate type heat exchanger; and a capacity controller are provided in such a manner as to reduce an operating capacity of said compressor in the case that the suction pressure of said compressor is continuously lower than or equal to a predetermined value for a fixed time.

* * * * *

UNITED STATES PATENT AND TRADEMARK OFFICE

CERTIFICATE OF CORRECTION

PATENT NO. : 6,532,755 B2
APPLICATION NO. : 10/152575
DATED : March 18, 2003
INVENTOR(S) : Ichikawa et al.

It is certified that error appears in the above-identified patent and that said Letters Patent is hereby corrected as shown below:

On the title page, items [45] and [30] should read:

(45) Date of Patent: * Mar. 18, 2003

(*) Notice: Subject to any disclaimer, the term of this patent is extended or adjusted under 35 U.S.C. 154(b) by 0 days.

This patent is subject to a terminal disclaimer

(30) Foreign Application Priority Data
Sep. 17, 1998 (JP) …….10-262713

Signed and Sealed this

Eighteenth Day of July, 2006

JON W. DUDAS
*Director of the United States Patent and Trademark Office*